US009903625B2

(12) United States Patent
Ariyama et al.

(10) Patent No.: US 9,903,625 B2
(45) Date of Patent: Feb. 27, 2018

(54) AIR-CONDITIONING APPARATUS

(75) Inventors: Tadashi Ariyama, Tokyo (JP); Osamu Morimoto, Tokyo (JP); Hirofumi Koge, Tokyo (JP); Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 217 days.

(21) Appl. No.: 14/412,035

(22) PCT Filed: Sep. 7, 2012

(86) PCT No.: PCT/JP2012/072848

§ 371 (c)(1),
(2), (4) Date: Dec. 30, 2014

(87) PCT Pub. No.: WO2014/038059

PCT Pub. Date: Mar. 13, 2014

(65) Prior Publication Data

US 2015/0168037 A1 Jun. 18, 2015

(51) Int. Cl.
*F25B 49/02* (2006.01)
*F25B 1/10* (2006.01)
(Continued)

(52) U.S. Cl.
CPC ..... *F25B 49/02* (2013.01); *F25B 1/10* (2013.01); *F25B 13/00* (2013.01); *F25B 30/02* (2013.01); *F25B 31/006* (2013.01); *F25B 41/00* (2013.01); *F25B 2313/0231* (2013.01); *F25B 2313/0233* (2013.01); *F25B 2313/0272* (2013.01); *F25B 2500/31* (2013.01); *F25B 2600/0271* (2013.01);
(Continued)

(58) Field of Classification Search
CPC ..... F25B 2400/054; F25B 31/008; F25B 2600/2509; F25B 2313/0231; F25B 1/10; F25B 30/02; F25B 2313/02323; F25B 2400/13; F25B 2400/0403; F25B 2400/0409
See application file for complete search history.

(56) References Cited

U.S. PATENT DOCUMENTS

2009/0199581 A1* 8/2009 Ushijima ..... F25B 30/02 62/238.7
2011/0113804 A1* 5/2011 Chin ..... F25B 1/04 62/222
2011/0232325 A1* 9/2011 Furui ..... F25B 13/00 62/510

FOREIGN PATENT DOCUMENTS

JP 5-1955 U 1/1993
JP 06-337172 A 12/1994
(Continued)

OTHER PUBLICATIONS

Extended European Search Report dated Apr. 21, 2016 in the corresponding EP application No. 12884004.8.
(Continued)

*Primary Examiner* — Schyler S Sanks
(74) *Attorney, Agent, or Firm* — Posz Law Group, PLC

(57) ABSTRACT

An air-conditioning apparatus includes an injection pipe allowing a part of a refrigerant, as discharged from a compressing device, to flow into an intermediate portion of a compression stroke of the compressing device, and an injection internal heat exchanger that exchanges heat between a refrigerant stream that flows through the injection pipe and a refrigerant stream that flows into a heat-source-side heat exchanger after passing through an indoor unit.

4 Claims, 7 Drawing Sheets

(51) Int. Cl.

| | |
|---|---|
| ***F25B 30/02*** | (2006.01) |
| ***F25B 41/00*** | (2006.01) |
| ***F25B 13/00*** | (2006.01) |
| ***F25B 31/00*** | (2006.01) |

(52) U.S. Cl.
CPC . *F25B 2600/2509* (2013.01); *F25B 2700/191* (2013.01); *F25B 2700/1931* (2013.01); *F25B 2700/2106* (2013.01)

(56) References Cited

FOREIGN PATENT DOCUMENTS

| | | | | | |
|---|---|---|---|---|---|
| JP | 2007-278686 | A | | 10/2007 | |
| JP | 2009-186121 | A | | 8/2009 | |
| JP | 2009-198099 | A | | 9/2009 | |
| JP | 2009198099 | A | * | 9/2009 | |
| WO | WO 2012014345 | A1 | * | 2/2012 | ..... F25B 1/10 |
| WO | 2012/104893 | A1 | | 8/2012 | |
| WO | WO 2012104892 | A1 | * | 8/2012 | ..... F25B 1/10 |

OTHER PUBLICATIONS

Office Action dated Aug. 18, 2015 issued in corresponding JP patent application No. 2014-534121 (and English translation).
International Search Report of the International Searching Authority dated Oct. 23, 2012 for the corresponding international application No. PCT/JP2012/072848 (and English translation).

* cited by examiner

AIR-CONDITIONING APPARATUS

CROSS REFERENCE TO RELATED APPLICATION

This application is a U.S. national stage application of PCT/JP2012/072848 filed on Sep. 7, 2012, the contents of which are incorporated herein by reference.

TECHNICAL FIELD

The present invention relates to an air-conditioning apparatus that performs air-conditioning by using a refrigeration cycle (heat pump cycle).

BACKGROUND

In, for example, an air-conditioning apparatus that uses a refrigeration cycle (heat pump cycle), a refrigerant circuit that circulates a refrigerant is formed by connecting a heat-source-device-side unit (to be also referred to as a heat source device or an outdoor unit hereinafter) including a compressor and a heat-source-device-side heat exchanger, and load-side units (to be also referred to as indoor units hereinafter) including flow control devices (for example, expansion valves) and indoor-unit-side heat exchangers to one another by refrigerant pipes. In the indoor-unit-side heat exchanger, air-conditioning is performed while changing, for example, the pressure and temperature of the refrigerant in the refrigerant circuit, using the fact that the refrigerant receives or transfers heat from or to the air in an air-conditioned space, which is to undergo heat exchange, when the refrigerant evaporates or condenses.

An exemplary air-conditioning apparatus has conventionally been available which is capable of performing a simultaneous cooling and heating operation (cooling and heating mixed operation) in which cooling or heating is performed in each of a plurality of indoor units by automatically determining whether to perform cooling or heating for each indoor unit, in accordance with the temperature set on a remote controller provided to a corresponding indoor unit, and the temperature of the environment surrounding this indoor unit.

In an air-conditioning apparatus to be installed in, for example, a cold climate area, if the temperature of the air on the outside (to be referred to as the outdoor air hereinafter) is low, the refrigerant is guided via an injection pipe into an intermediate portion of a compression stroke of a compressor, provided in a heat source device, so as to improve the heating capacity (see, for example, Patent Literature 1). Such a configuration improves the capacity by increasing the density of refrigerant discharged from the compressor.

Guiding the refrigerant via the injection pipe into the intermediate portion of the compression stroke of the compressor will be referred to as "injection" hereinafter. The heating capacity refers to the amount of heat supplied to the indoor unit per unit time by refrigerant circulation during heating. Likewise, the cooling capacity refers to the amount of heat supplied to the indoor unit per unit time by refrigerant circulation during cooling. The heating capacity and the cooling capacity will sometimes be collectively referred to as "the capacity" hereinafter.

PATENT LITERATURE

Patent Literature 1: Japanese Unexamined Patent Application Publication No. 2009-198099

On the low-pressure side of the refrigeration cycle (to be simply referred to as the low-pressure side hereinafter), the refrigerant is susceptible, for example, to the temperature of the outdoor air, and the mode of operation. Therefore, if the refrigerant on the low-pressure side is injected into the compressor via a bypass during a heating operation performed in an environment in which the temperature of the outdoor air is low, a sufficient differential pressure cannot sometimes be obtained with respect to the pressure of the refrigerant that is being compressed.

Hence, the amount of refrigerant to be injected may become insufficient. Consequently, the temperature of the refrigerant as discharged from the compressor (to be referred to as the discharge temperature hereinafter) may rise excessively.

If the other end of the injection pipe is connected to a portion at which the refrigerant discharged from the compressing device is divided and flows into the injection pipe while the refrigerant, as condensed by coming into contact with and exchanging heat with a part of the heat-source-device-side heat exchanger, flows into the intermediate portion of the compression stroke, the heated gas refrigerant as injected cannot be supplied to those indoor units that are performing heating. Therefore, to ensure a satisfactory capacity, the total amount of circulation needs to be increased correspondingly.

SUMMARY

The present invention has been made in order to solve the above-described problems, and has as its object to provide an air-conditioning apparatus which can suppress a rise in discharge temperature of a compressing device and ensure a satisfactory capacity even if the temperature of the outdoor air is low.

An air-conditioning apparatus according to the present invention includes a heat source device including a compressing device that compresses a refrigerant, and a heat-source-side heat exchanger that exchanges heat between the refrigerant and outdoor air; an indoor unit including an indoor heat exchanger that exchanges heat between conditioned air and the refrigerant, and expansion means; a refrigerant pipe that connects the heat source device and the indoor unit to each other and forms a refrigerant circuit; an injection pipe allowing a part of the refrigerant, as discharged from the compressing device, to flow into an intermediate portion of a compression stroke of the compressing device; and an injection internal heat exchanger that exchanges heat between a refrigerant stream that flows through the injection pipe and a refrigerant stream that flows into the heat-source-side heat exchanger after passing through the indoor unit.

According to the present invention, an excessive rise in discharge temperature of the compressing device can be suppressed, and a satisfactory capacity can be ensured even if the temperature of the outdoor air is low.

DETAILED DESCRIPTION

Embodiments of the present invention will now be described with reference to the accompanying drawings.

Embodiment 1

Figure 1:
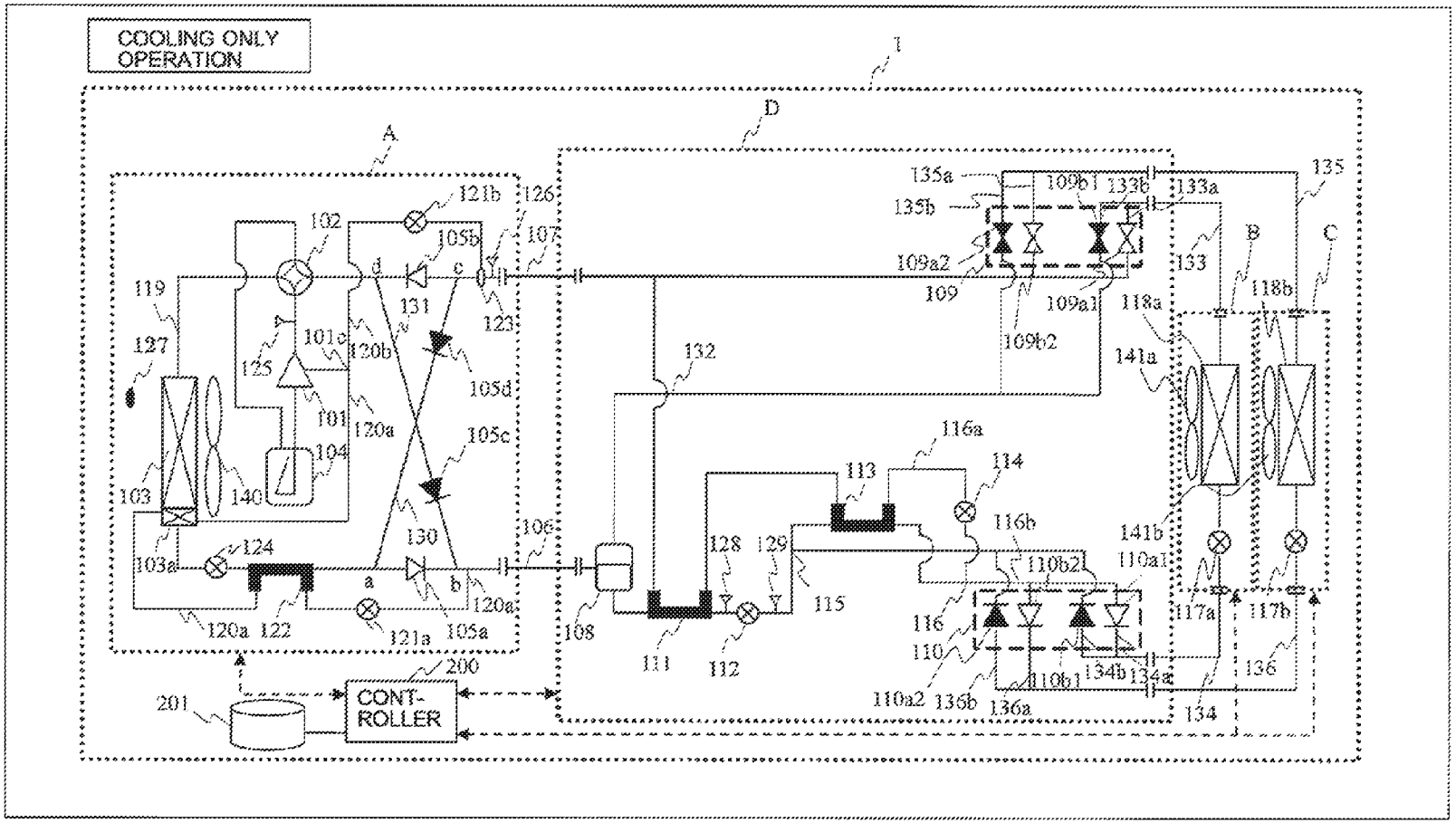
FIG. 1 is a refrigerant circuit diagram of an air-conditioning apparatus according to Embodiment 1 in a cooling only operation.

FIG. 1 is a refrigerant circuit diagram of an air-conditioning apparatus according to Embodiment 1 in a cooling only operation.

An exemplary configuration of a refrigerant circuit of an air-conditioning apparatus 1 will now be described with reference to FIG. 1.

The air-conditioning apparatus 1 is installed in a building such as an office building, an apartment, or a condominium.

The air-conditioning apparatus 1 performs a cooling/heating operation by using a refrigeration cycle (heat pump cycle) in which a refrigerant (a refrigerant for air-conditioning) circulates.

The air-conditioning apparatus 1 is capable of performing a simultaneous cooling and heating operation in which cooling and heating are performed simultaneously in combination in a plurality of indoor units.

An operation in which all indoor units that are in operation perform cooling will be referred to as a cooling only operation.

An operation in which all indoor units that are in operation perform heating will be referred to as a heating only operation.

An operation in which some indoor units perform cooling while others perform heating and cooling involves a higher load will be referred to as a cooling main operation.

An operation in which some indoor units perform cooling while others perform heating and heating involves a higher load will be referred to as a heating main operation.

[Overall Configuration]

The air-conditioning apparatus 1 includes a heat source device A, a plurality of indoor units B and C, and a relay device D.

The relay device D is provided between the heat source device A and the indoor units B and C.

The relay device D controls the flow of the refrigerant.

The relay device D is connected to the heat source device A by a first main pipe 107 and a second main pipe 106.

The plurality of indoor units B and C are connected in parallel to the relay device D. The indoor unit B is connected by connection pipes 133 and 134. The indoor unit C is connected by connection pipes 135 and 136.

A controller 200 controls the operation of the air-conditioning apparatus 1.

The heat source device A and the relay device D are connected to each other by the first main pipe 107 and the second main pipe 106.

The first main pipe 107 has a diameter larger than that of the second main pipe 106.

The second main pipe 106 guides the refrigerant from the heat source device A to the relay device D.

The first main pipe 107 guides the refrigerant from the relay device D to the heat source device A.

The refrigerant flowing through the first main pipe 107 has a pressure lower than that of the refrigerant flowing through the second main pipe 106.

Note that a high or low pressure and a high or low stage do not refer to those defined by the relationship with a reference pressure (numerical value).

A high or low pressure refers to that relative to pressures (including an intermediate pressure) in the refrigerant circuit when pressurization is done by a compressing device 101, the open/closed states (opening degrees) of respective flow control devices are controlled, or other operations are done.

The refrigerant has a highest pressure when it is discharged from the compressing device 101.

Since the flow control devices or other devices reduce the pressure of the refrigerant, the refrigerant has a lowest pressure when it is drawn into the compressing device 101 by suction.

The relay device D and the indoor unit B are connected to each other by the connection pipes 134 and 133.

The relay device D and the indoor unit C are connected to each other by the connection pipes 136 and 135.

By connection using the first main pipe 107, the second main pipe 106, the connection pipes 134 and 133, the refrigerant circulates through the heat source device A, the relay device D, and the indoor unit B.

By connection using the first main pipe 107, the second main pipe 106, the connection pipes 136 and 135, the refrigerant circulates through the heat source device A, the relay device D, and the indoor unit C.

[Heat Source Device A]

The heat source device A includes the compressing device 101, a four-way switching valve 102, a heat-source-side heat exchanger 103, an accumulator 104, check valves 105*a*, 105*b*, 105*c*, and 105*d*, and an injection internal heat exchanger 122.

The heat source device A also includes injection pipes 120*a* and 120*b*, injection flow control devices 121*a* and 121*b*, and a gas-liquid separating device 123.

The "injection pipe 120*a*" corresponds to the "injection pipe" according to the present invention.

The "injection pipe 120*b*" corresponds to the "second injection pipe" according to the present invention.

The "injection flow control device 121*a*" corresponds to the "injection flow control device" according to the present invention.

The "injection flow control device 121*b*" corresponds to the "second injection flow control device" according to the present invention.

Figure 2:
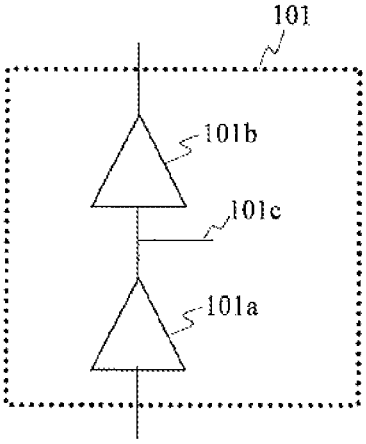
FIG. 2 is a diagram illustrating an exemplary configuration of a compressing device in the air-conditioning apparatus according to Embodiment 1.

FIG. 2 is a diagram illustrating an exemplary configuration of the compressing device in the air-conditioning apparatus according to Embodiment 1.

The compressing device 101 pressurizes the refrigerant as drawn by suction, and discharges (delivers) the refrigerant.

As illustrated in FIG. 2, the compressing device 101 has a two-stage configuration including a low-stage-side compressor 101*a* and a high-stage-side compressor 101*b*.

The driving frequencies of the low-stage-side compressor 101*a* and the high-stage-side compressor 101*b* can be arbitrarily changed.

The driving frequencies of the low-stage-side compressor 101*a* and the high-stage-side compressor 101*b* are controlled by an inverter circuit (not illustrated) on the basis of instructions sent by the controller 200.

The compressing device 101 as a whole is capable of changing the amount of discharge (the amount of refrigerant discharged per unit time), and the capacity in correspondence with the amount of discharge.

The driving frequencies of the low-stage-side compressor 101*a* and the high-stage-side compressor 101*b* may be determined in advance at a predetermined ratio in accordance with the stroke volumes of the respective compressors.

The predetermined ratio refers to that when the suction pressure of the high-stage-side compressor 101*b* is equal to a predetermined value.

An injection port 101*c* is provided in an intermediate portion of the compression stroke between the low-stage-side compressor 101*a* and the high-stage-side compressor 101*b*.

The injection port 101*c* allows the refrigerant flowing from the injection pipes 120*a* and 120*b* to be drawn into the high-stage-side compressor 101*b* by suction.

For example, in an environment in which the temperature of the outdoor air is low, if the pressure on the low-pressure side of the refrigerant circuit reduces and the density of refrigerant drawn into the low-stage-side compressor 101*a* by suction reduces, the controller 200 increases the rotation speed of the compressing device 101 by using the inverter circuit. Thus, a reduction in flow rate of the refrigerant is prevented, and a certain heating capacity is maintained.

When the pressure on the low-pressure side of the refrigerant circuit reduces, the compressing device 101 operates at a high compression ratio, leading to a high discharge temperature. In such a case, the controller 200 supplies the refrigerant, as cooled in the heat-source-side heat exchanger 103, into the compressing device 101 via the injection port 101*c*. Thus, a rise (an excessive rise) in temperature of the refrigerant, as discharged from the compressing device 101, is prevented.

The four-way switching valve 102 switches the passage of the refrigerant on the basis of instructions sent by the controller 200.

The four-way switching valve 102 switches the passage of the refrigerant among that for the cooling only operation, that for the heating only operation, that for the cooling main operation, and that for the heating main operation.

The heat-source-side heat exchanger 103 includes heat transfer tubes which pass the refrigerant, and fins provided for increasing the area of heat transfer between the refrigerant flowing through the heat transfer tubes and the air (the outdoor air).

The heat-source-side heat exchanger 103 exchanges heat between the refrigerant and the air (the outdoor air).

The heat-source-side heat exchanger 103 functions as an evaporator in the heating only operation and the heating main operation, and evaporates the refrigerant into a gas.

The heat-source-side heat exchanger 103 functions as a condenser in the cooling only operation and the cooling main operation, and condenses the refrigerant into a liquid.

In, for example, the cooling main operation, the heat-source-side heat exchanger 103 does not completely gasify or liquefy the refrigerant but may control the refrigerant state such that, for example, the refrigerant condenses into a two-phase mixture composed of a liquid and a gas (two-phase gas-liquid refrigerant).

An air-sending device 140 is provided near the heat-source-side heat exchanger 103.

The air-sending device 140 sends air to the heat-source-side heat exchanger 103 so as to efficiently exchange heat between the refrigerant and the air.

The air-sending device 140 changes the volume of airflow on the basis of instructions sent by the controller 200.

With a change in volume of airflow produced by the air-sending device 140, the heat exchange capacity of the heat-source-side heat exchanger 103 can be changed.

The accumulator 104 is provided between the compressing device 101 and the four-way switching valve 102.

The accumulator 104 stores an excess amount of refrigerant in the refrigerant circuit.

The check valve 105*a* is provided in a pipe extending between the heat-source-side heat exchanger 103 and the second main pipe 106.

The check valve 105*a* supplies the refrigerant only in one direction from the heat-source-side heat exchanger 103 toward the second main pipe 106.

The check valve 105*b* is provided in a pipe extending between the four-way switching valve 102 and the first main pipe 107.

The check valve 105*b* supplies the refrigerant only in one direction from the first main pipe 107 toward the four-way switching valve 102.

The second main pipe 106 and the first main pipe 107 are connected to each other by a connection pipe 130 that connects the upstream ends of the check valves 105*a* and 105*b* to each other.

The second main pipe 106 and the first main pipe 107 are also connected to each other by a connection pipe 131 that connects the downstream ends of the check valves 105*a* and 105*b* to each other.

That is, a connection portion "a" between the second main pipe 106 and the connection pipe 130 is located upstream of a connection portion "b" between the second main pipe 106 and the connection pipe 131, and opposed to the connection portion "b" across the check valve 105*a*.

A connection portion "c" between the first main pipe 107 and the connection pipe 130 is located upstream of a connection portion "d" between the first main pipe 107 and the connection pipe 131, and opposed to the connection portion "d" across the check valve 105*b*.

The connection pipe 130 is provided with the check valve 105*d*.

The check valve 105*d* supplies the refrigerant only in one direction from the first main pipe 107 toward the second main pipe 106.

The connection pipe 131 is provided with the check valve 105*c*.

The check valve 105*c* supplies the refrigerant only in one direction from the first main pipe 107 toward the second main pipe 106.

Referring to FIG. 1, among the check valves 105*a* to 105*d*, open check valves are represented by open marks, and closed check valves are represented by filled marks. The same applies to refrigerant circuit diagrams to be described below, in which among the check valves 105*a* to 105*d*, open check valves are represented by open marks, and closed check valves are represented by filled marks.

One end of the injection pipe 120*a* is connected to a pipe extending between the check valve 105*a* and the second main pipe 106.

The other end of the injection pipe 120*a* is connected to the injection port 101*c*.

The injection pipe 120*a* passes the refrigerant that is to flow into the high-stage-side compressor 101*b* of the compressing device 101.

The injection pipe 120*a* is provided with the injection flow control device 121*a*.

The injection flow control device 121*a* controls, on the basis of instructions sent by the controller 200, the flow rate and pressure of the refrigerant that passes through the injection pipe 120*a*.

The injection internal heat exchanger 122 is provided in a pipe extending between the check valve 105*a* and a flow control device 124.

The injection internal heat exchanger 122 exchanges heat between a refrigerant stream that flows through the injection pipe 120*a* and a refrigerant stream that flows through the heat-source-side heat exchanger 103.

The heat-source-side heat exchanger 103 includes an injection heat exchanging portion 103*a* that exchanges heat between a refrigerant stream that flows through the heat-source-side heat exchanger 103 and a refrigerant stream that flows through the injection pipe 120*a* when the heat-source-side heat exchanger 103 functions as an evaporator.

The injection heat exchanging portion 103*a* may be omitted.

One end of the injection pipe 120*b* is connected to the gas-liquid separating device 123.

The other end of the injection pipe 120*b* is connected to the injection port 101*c*.

The injection pipe 120*b* passes the refrigerant that is to flow (to be supplied) into the high-stage-side compressor 101*b* of the compressing device 101.

The injection pipe 120*b* is provided with the injection flow control device 121*b*.

The injection flow control device 121*b* controls, on the basis of instructions sent by the controller 200, the flow rate and pressure of the refrigerant that passes through the injection pipe 120*b*.

The gas-liquid separating device 123 separates the refrigerant that has passed through the first main pipe 107 into gas and liquid refrigerants.

The gas-liquid separating device 123 supplies at least a part of the separated liquid refrigerant into the injection pipe 120*b*.

The gas-liquid separating device 123 may have a simple arrangement in which the refrigerant is drawn by suction in the lateral direction from a pipe extending vertically, and is thereby separated into a liquid refrigerant that flows downwards and a gas refrigerant that flows upwards.

In the cooling only operation or the cooling main operation, a high-pressure liquid refrigerant or a two-phase gas-liquid refrigerant flows through the first main pipe 107. Since the gas-liquid separating device 123 is provided, the cooling capacity can be kept as high as possible, free from the influence of a significant pressure loss.

The heat source device A is provided with pressure detectors 125 and 126, and an outdoor air temperature detector 127.

The pressure detector 125 is provided to a pipe connected to the discharge end of the compressing device 101.

The pressure detector 125 detects the pressure of the refrigerant as discharged from the compressing device 101.

The pressure detector 125 may be implemented using a pressure sensor.

The controller 200 obtains a signal detected by the pressure detector 125.

On the basis of the signal detected by the pressure detector 125, the controller 200 detects, for example, a pressure Pd and a temperature Td of the refrigerant as discharged from the compressing device 101.

On the basis of the pressure Pd, the controller 200 calculates, for example, a condensing temperature Tc.

The pressure detector 126 is provided to a pipe that connects the heat source device A and the first main pipe 107 to each other.

The pressure detector 126 detects the pressure of the refrigerant that flows from the relay device D (the indoor units B and C) into the heat source device A.

The outdoor air temperature detector 127 detects the temperature of the outdoor air (the outdoor air temperature).

[Relay Device D]

The relay device D includes a gas-liquid separating device 108, a first branch portion 109, a second branch portion 110, a first heat exchanger 111, and a second heat exchanger 113.

The gas-liquid separating device 108 separates the refrigerant, upon flowing from the second main pipe 106 into the relay device D, into gas and liquid refrigerants.

The gas-liquid separating device 108 includes a gas-phase portion out of which the gas refrigerant flows, and a liquid-phase portion out of which the liquid refrigerant flows.

The gas-phase portion of the gas-liquid separating device 108 is connected to the first branch portion 109.

The liquid-phase portion of the gas-liquid separating device 108 is connected to the second branch portion 110 via the first heat exchanger 111 and the second heat exchanger 113.

In the first branch portion 109, connection pipe 133 includes two branched connection pipes 133*a* and 133*b*.

The branched connection pipe 133*a* is connected to the first main pipe 107.

The branched connection pipe 133*b* is connected to a connection pipe 132.

In the first branch portion 109, connection pipe 135 includes two branched connection pipes 135*a* and 135*b*.

The branched connection pipe 135*a* is connected to the first main pipe 107.

The branched connection pipe 135*b* is connected to a connection pipe 132.

The connection pipe 132 connects the gas-liquid separating device 108 and the first branch portion 109 to each other.

The connection pipe 133*a* that is connected to the indoor unit B is provided with a switching valve 109*a*1.

The connection pipe 135*a* that is connected to the indoor unit C is provided with a switching valve 109*b*2.

The connection pipe 133*b* that is connected to the indoor unit B is provided with a switching valve 109*b*1.

The connection pipe 135*b* that is connected to the indoor unit C is provided with a switching valve 109*a*2.

The switching valves 109*a*1, 109*a*2, 109*b*1, and 109*b*2 are set open or closed under the control of the controller 200, whereby the refrigerant is enabled or disabled to pass through them.

Referring to FIG. 1, among the switching valves 109*a*1, 109*a*2, 109*b*1, and 109*b*2, open switching valves are represented by open marks, and closed switching valves are represented by filled marks. The same applies to refrigerant circuit diagrams to be described below, in which among the switching valves 109*a*1, 109*a*2, 109*b*1, and 109*b*2, open switching valves are represented by open marks, and closed switching valves are represented by filled marks.

In the second branch portion 110, the connection pipe 134 includes two branched connection pipes 134*a* and 134*b*.

The branched connection pipe 134*b* is connected via a first merging portion 115 to a pipe extending between a first flow control device 112 (to be described later) and the second heat exchanger 113.

The branched connection pipes 134*a* is connected via a second merging portion 116 to a pipe extending between a second flow control device 114 (to be described later) and the second heat exchanger 113.

In the second branch portion 110, the connection pipe 136 includes two branched connection pipes 136*a* and 136*b*.

The branched connection pipe 136*b* is connected via a first merging portion 115 to a pipe extending between a first flow control device 112 (to be described later) and the second heat exchanger 113.

The branched connection pipes 136*a* is connected via a second merging portion 116 to a pipe extending between a second flow control device 114 (to be described later) and the second heat exchanger 113.

The connection pipe 134*a* that is connected to the indoor unit B is provided with a check valve 110*a*1.

The connection pipe 136*a* that is connected to the indoor unit C is provided with a check valve 110*b*2.

The connection pipe 134*b* that is connected to the indoor unit B is provided with a check valve 110*b*1.

The connection pipe 136*b* that is connected to the indoor unit C is provided with another check valve 110*a*2.

Each of the check valves 110*a*1, 110*a*2, 110*b*1, and 110*b*2 supplies the refrigerant only in one direction.

Referring to FIG. 1, among the check valves 110*a*1, 110*a*2, 110*b*1, and 110*b*2, open check valves are represented by open marks, and closed check valves are represented by filled marks. The same applies to refrigerant circuit diagrams to be described below, in which among the check valves 110*a*1, 110*a*2, 110*b*1, and 110*b*2, open check valves are represented by open marks, and closed check valves are represented by filled marks.

The first merging portion 115 connects the gas-liquid separating device 108 and the second branch portion 110 to each other via the first flow control device 112 and the first heat exchanger 111.

The second merging portion 116 provides branches each extending between the second branch portion 110 and the second heat exchanger 113.

One branch is connected to the first merging portion 115 via the second heat exchanger 113.

The other branch that forms a first bypass pipe 116*a* is connected to the first main pipe 107 via the second flow control device 114, the second heat exchanger 113, and the first heat exchanger 111.

The first heat exchanger 111 is provided between the gas-liquid separating device 108 and the first flow control device 112.

The first heat exchanger 111 exchanges heat between a refrigerant stream that flows from the gas-liquid separating device 108 toward the first merging portion 115, and a refrigerant stream that flows from the second heat exchanger 113 to the first main pipe 107.

In, for example, the cooling only operation, the first heat exchanger 111 supercools and supplies the liquid refrigerant to the indoor units B and C.

The first heat exchanger 111 is connected to the first main pipe 107 by a pipe, and supplies, into the first main pipe 107, the refrigerant streams that flow from the indoor units B and C and the refrigerant stream used for supercooling.

The second heat exchanger 113 is provided between the first merging portion 115 and the second merging portion 116.

The second heat exchanger 113 exchanges heat between a refrigerant stream that flows from the first merging portion 115 to the second merging portion 116, and a refrigerant stream that branches off at the second merging portion 116 and flows through the first bypass pipe 116*a*.

In, for example, the cooling only operation, the second heat exchanger 113 supercools and supplies the liquid refrigerant to the indoor units B and C. The second heat exchanger 113 is connected to the first main pipe 107 by a pipe, and supplies, into the first main pipe 107, the refrigerant streams that flow from the indoor units B and C and the refrigerant stream used for supercooling.

The first flow control device 112 is provided between the first heat exchanger 111 and the second heat exchanger 113.

The first flow control device 112 has its opening degree controlled on the basis of instructions sent by the controller 200.

The first flow control device 112 controls the flow rate and pressure of the refrigerant flowing from the gas-liquid separating device 108 to the first heat exchanger 111.

The second flow control device 114 is provided in the first bypass pipe 116*a* extending between the second merging portion 116 and the second heat exchanger 113.

The second flow control device 114 has its opening degree controlled on the basis of instructions sent by the controller 200.

The second flow control device 114 controls the flow rate and pressure of the refrigerant flowing through the first bypass pipe 116*a*.

The relay device D is provided with pressure detectors 128 and 129.

The pressure detector 128 is provided to a pipe extending between the first heat exchanger 111 and the first flow control device 112.

The pressure detector 128 detects the pressure of the refrigerant flowing from the first heat exchanger 111 to the first flow control device 112.

The pressure detector 129 is provided to a pipe extending between the first flow control device 112 and the first merging portion 115.

The pressure detector 129 detects the pressure of the refrigerant flowing from the first flow control device 112 to the first merging portion 115.

The controller 200 obtains signals detected by the pressure detectors 128 and 129.

On the basis of the difference between the pressures detected by the pressure detectors 128 and 129, the controller 200 determines the opening degree of the second flow control device 114.

The refrigerant having flowed through the second flow control device 114 and the first bypass pipe 116*a* supercools the refrigerant pools in, for example, the second heat exchanger 113 and the first heat exchanger 111, and flows into the first main pipe 107.

The second heat exchanger 113 exchanges heat between a refrigerant stream which passes through the second flow control device 114 and flows through the first bypass pipe 116*a*, and a refrigerant stream that flows from the first flow control device 112.

The first heat exchanger 111 exchanges heat between a refrigerant stream having passed through the first bypass pipe 116*a* and the second heat exchanger 113, and a refrigerant stream that flows from the gas-liquid separating device 108 to the first flow control device 112.

A second bypass pipe 116*b* supplies the refrigerant which passes through the second heat exchanger 113 and flows into the indoor unit B via the check valve 110*a*1

The second bypass pipe 116*b* supplies the refrigerant which passes through the second heat exchanger 113 and flows into the indoor unit C via the check valve 110*b*2

In the cooling main operation and the heating main operation, the refrigerant having passed through the second bypass pipe 116*b* flows through the second heat exchanger 113. Subsequently, the refrigerant partially or wholly flows into either of the indoor units B and C that is performing cooling.

In, for example, the heating only operation, the refrigerant wholly passes through the second flow control device 114 and the first bypass pipe 116*a* and flows into the first main pipe 107.

[Indoor Units B and C]

The indoor unit B includes an expansion means 117*a* and an indoor heat exchanger 118*a* that are connected in series to each other.

The indoor unit C includes an expansion means 117*b* and an indoor heat exchanger 118*b* that are connected in series to each other.

According to Embodiment 1, in the cooling main operation and the heating main operation, the indoor unit B receives cooling energy supplied from the heat source device A and takes charge of a cooling load, while the indoor unit C receives heating energy supplied from the heat source device A and takes charge of a heating load.

In the cooling only operation, both the indoor units B and C receive cooling energy supplied from the heat source device A and take charge of a cooling load.

In the heating only operation, both the indoor units B and C receive heating energy supplied from the heat source device A and take charge of a heating load.

The indoor heat exchangers 118*a* and 118*b* include heat transfer tubes which pass the refrigerant, and fins provided to increase the area of heat transfer between the refrigerant flowing through the heat transfer tubes and the indoor air. The indoor heat exchangers 118*a* and 118*b* exchange heat between the refrigerant and the indoor air.

The indoor heat exchangers 118*a* and 118*b* function as a radiator (condenser) or an evaporator.

The indoor heat exchangers 118*a* and 118*b* condense the refrigerant into a liquid or evaporates it into a gas.

Air-sending devices 141*a* and 141*b* are provided near the indoor heat exchangers 118*a* and 118*b*, respectively.

The air-sending devices 141*a* and 141*b* send the air to the indoor heat exchangers 118*a* and 118*b* so that heat is efficiently exchanged between the refrigerant and the air, respectively.

The air-sending devices 141*a* and 141*b* change the volume of airflow on the basis of instructions sent by the controller 200. With a change in volume of airflow caused by the air-sending devices 141*a* and 141*b*, the heat exchange capacity of the indoor heat exchangers 118*a* and 118*b* can be changed respectively.

The expansion means 117*a* and 117*b* function as a pressure reducing valve or an expansion valve.

The expansion means 117*a* and 117*b* decompress and expand the refrigerant. The opening degree of the expansion means 117*a* and 117*b* is variable.

[Controller 200 and Storage Means 201]

The controller 200 performs, for example, determination processes on the basis of signals transmitted from various detectors (sensors) provided inside and outside the air-conditioning apparatus 1 and from the devices (means) in the air-conditioning apparatus 1.

The controller 200 operates the devices on the basis of the results obtained by the determination processes or other processes.

The controller 200 systematically controls the operation of the overall air-conditioning apparatus 1.

Specifically, the controller 200 controls, for example, the driving frequency of the compressing device 101, the opening degrees of flow control devices including the flow control device 124, and the switching of the four-way switching valve 102, the switching valves 109*a*1, 109*a*2, 109*b*1, and 109*b*2, and the expansion means 117*a* and 117*b*.

A storage means 201 temporarily or for a long period of time stores various types of data, programs, and other types of information which are necessary for the above-mentioned processes of the controller 200.

While Embodiment 1 assumes that the controller 200 and the storage means 201 are provided independently of the heat source device A, the present invention is not limited to such a case. For example, the controller 200 and the storage means 201 may be included in the heat source device A.

While Embodiment 1 assumes that the controller 200 and the storage means 201 are included in the air-conditioning apparatus 1, the present invention is not limited to such a case. For example, the controller 200 and the storage means 201 may be provided outside the air-conditioning apparatus 1, and the air-conditioning apparatus 1 may be remotely controlled by signal communication over a telecommunications network or the like.

[Operation]

The air-conditioning apparatus 1 according to Embodiment 1 performs any of the cooling only operation, the heating only operation, the cooling main operation, and the heating main operation.

The heat-source-side heat exchanger 103 functions as a condenser in the cooling only operation and the cooling main operation.

The heat-source-side heat exchanger 103 functions as an evaporator in the heating only operation and the heating main operation.

The operations of the devices and the flow of the refrigerant in each operation will now be described.

[Cooling Only Operation]

The operations of the devices and the flow of the refrigerant in the cooling only operation will be described with reference to FIG. 1.

The following description assumes that all indoor units are performing cooling without interruption.

The compressing device 101 compresses the refrigerant drawn by suction and discharges a high-pressure gas refrigerant.

The high-pressure gas refrigerant discharged from the compressing device 101 flows through the four-way switching valve 102 into the heat-source-side heat exchanger 103.

While passing through the heat-source-side heat exchanger 103, the high-pressure gas refrigerant is condensed by exchanging heat with the outdoor air, and turns into a high-pressure liquid refrigerant.

The high-pressure liquid refrigerant flows through the check valve 105*a*.

In this process, the high-pressure liquid refrigerant does not flow toward the check valve 105*c* or 105*d* because of factors associated with the relationship of pressure of the refrigerant.

The high-pressure liquid refrigerant then flows through the second main pipe 106 into the relay device D.

The gas-liquid separating device 108 separates the refrigerant having flowed into the relay device D into gas and liquid refrigerants.

The refrigerant that flows into the relay device D in the cooling only operation is a liquid refrigerant.

The controller 200 switches the switching valve 109*a*1 that is provided in the connection pipe 133*a* to an open state.

The controller 200 switches the switching valve 109*b*2 that is provided in the connection pipe 135*a* to an open state.

The controller 200 switches the switching valve 109*b*1 that is provided in the connection pipe 133*b* to a closed state.

The controller 200 switches the switching valve 109*a*2 that is provided in the connection pipe 135*b* to a closed state.

Therefore, the gas refrigerant separated by the gas-liquid separating device 108 does not flow from the gas-liquid separating device 108 to the indoor units B and C.

The liquid refrigerant separated by the gas-liquid separating device 108 flows through the first heat exchanger 111, the first flow control device 112, and the second heat exchanger 113, and a part of the liquid refrigerant flows into the second branch portion 110.

The refrigerant having flowed into the second branch portion 110 is divided into refrigerant streams that flow through the check valve 110*a*1 connected to the connection pipe 134*a* and the check valve 110*b*2 connected to the connection pipe 136*a*, flow through the connection pipes 134 and 136, and flow into the indoor units B and C, respectively.

The controller 200 controls the opening degrees of the expansion means 117*a*. In the indoor unit, the expansion means 117*a* controls the pressure of the liquid refrigerant having flowed into it from the connection pipe 134.

The opening degree of the expansion means 117*a* is controlled on the basis of the degree of superheat of the refrigerant at the outlet of the indoor heat exchanger 118*a*.

A low-pressure liquid refrigerant or a two-phase gas-liquid refrigerant generated by controlling the opening degree of the expansion means 117*a* flows into the indoor heat exchanger 118*a*.

The low-pressure liquid refrigerant or the two-phase gas-liquid refrigerant evaporates by exchanging heat with the indoor air in the air-conditioned space while passing through the indoor heat exchanger 118*a*.

In this process, the refrigerant exchanges heat with the indoor air and cools it, whereby the indoor space is cooled.

The refrigerant having passed through the indoor heat exchanger 118*a* turns into a low-pressure gas refrigerant and flows into a corresponding connection pipe 133.

The controller 200 controls the opening degrees of the expansion means 117*b*. In the indoor unit C, the expansion means 117*b* controls the pressure of the liquid refrigerant having flowed into it from the connection pipe 136.

The opening degree of the expansion means 117*b* is controlled on the basis of the degree of superheat of the refrigerant at the outlet of the indoor heat exchanger 118*b*.

A low-pressure liquid refrigerant or a two-phase gas-liquid refrigerant generated by controlling the opening degree of the expansion means 117*b* flows into the indoor heat exchanger 118*b*.

The low-pressure liquid refrigerant or the two-phase gas-liquid refrigerant evaporates by exchanging heat with the indoor air in the air-conditioned space while passing through the indoor heat exchanger 118*b*.

In this process, the refrigerant exchanges heat with the indoor air and cools it, whereby the indoor space is cooled.

The refrigerant having passed through the indoor heat exchanger 118*b* turns into a low-pressure gas refrigerant and flows into a corresponding connection pipe 135.

The refrigerant having passed through the indoor heat exchangers 118*a* and 118*b* may turn into a two-phase gas-liquid refrigerant.

If, for example, the air-conditioning load of at least one of the indoor units B and C is small or shifting because, for example, operation has just started, the refrigerant is not completely gasified in at least one of the indoor heat exchangers 118*a* and 118*b*, and turns into a two-phase gas-liquid refrigerant.

The air-conditioning load refers to the amount of heat necessary for each of the indoor units B and C, and will also be simply referred to as the load hereinafter.

The low-pressure gas refrigerant or the two-phase gas-liquid refrigerant (low-pressure refrigerant) having flowed through the connection pipe 133 flows through the switching valve 109*a*1 connected to the connection pipe 133*a*, and flows into the first main pipe 107.

The low-pressure gas refrigerant or the two-phase gas-liquid refrigerant (low-pressure refrigerant) having flowed through each connection pipe 135 flows through a corresponding one of the switching valve 109*b*2 connected to the connection pipe 135*a*, and flows into the first main pipe 107.

The refrigerant having passed through the first main pipe 107 into the heat source device A flows through the check valve 105*b*, the four-way switching valve 102, and the accumulator 104, and returns to the compressing device 101.

The above-mentioned arrangement corresponds to a basic circulation passage of the refrigerant in the cooling only operation.

In the cooling only operation, the controller 200 sets the opening degrees of the injection flow control devices 121*a* and 121*b* to zero.

The injection flow control device 121*a* is set to zero opening degree, and does not supply the refrigerant into the injection pipe 120*a*.

The injection flow control device 121*b* is set to zero opening degree, and does not supply the refrigerant into the injection pipe 120*b*.

The flow of the refrigerant in the first heat exchanger 111 and the second heat exchanger 113 will now be described.

The liquid refrigerant separated by the gas-liquid separating device 108 passes through the first heat exchanger 111, the first flow control device 112, and the second heat exchanger 113. Then, a part of the liquid refrigerant flows into the second branch portion 110, while the remaining part of the liquid refrigerant flows into the second flow control device 114.

The refrigerant having flowed into the second flow control device 114 passes through the first bypass pipe 116*a*, supercools the refrigerant stream flowing from the gas-liquid separating device 108 in the second heat exchanger 113 and the first heat exchanger 111, and flows into the first main pipe 107.

By supercooling and supplying the refrigerant toward the second branch portion 110, the enthalpy of the refrigerant on the inlet side (the side of the connection pipes 134 and 136) can be reduced. Hence, the amount of heat exchanged with the air in the indoor heat exchangers 118*a* and 118*b* can be increased.

If the opening degree of the second flow control device 114 is large, and the amount of refrigerant flowing through the first bypass pipe 116*a* (the refrigerant to be used for supercooling) is thus relatively large, too little refrigerant may evaporate in the indoor heat exchangers 118*a* and 118*b*.

Therefore, the controller 200 controls the opening degree of the second flow control device 114 such that the difference between pressures detected by the pressure detectors 128 and 129 reaches a predetermined value, thereby controlling the degree of superheat of the refrigerant at the outlet of the first flow control device 112.

The controller 200 controls the discharge capacity of the compressing device 101 and the volume of airflow produced by the air-sending devices 140, 141*a* and 141, and provides a capacity corresponding to the load imposed on the indoor units B and C.

With this operation, the controller 200 controls the evaporating temperatures of the refrigerant in the indoor heat exchangers 118*a* and 118*b* and the condensing temperature of the refrigerant in the heat-source-side heat exchanger 103 to reach predetermined target temperatures.

[Heating Only Operation]

Figure 3:
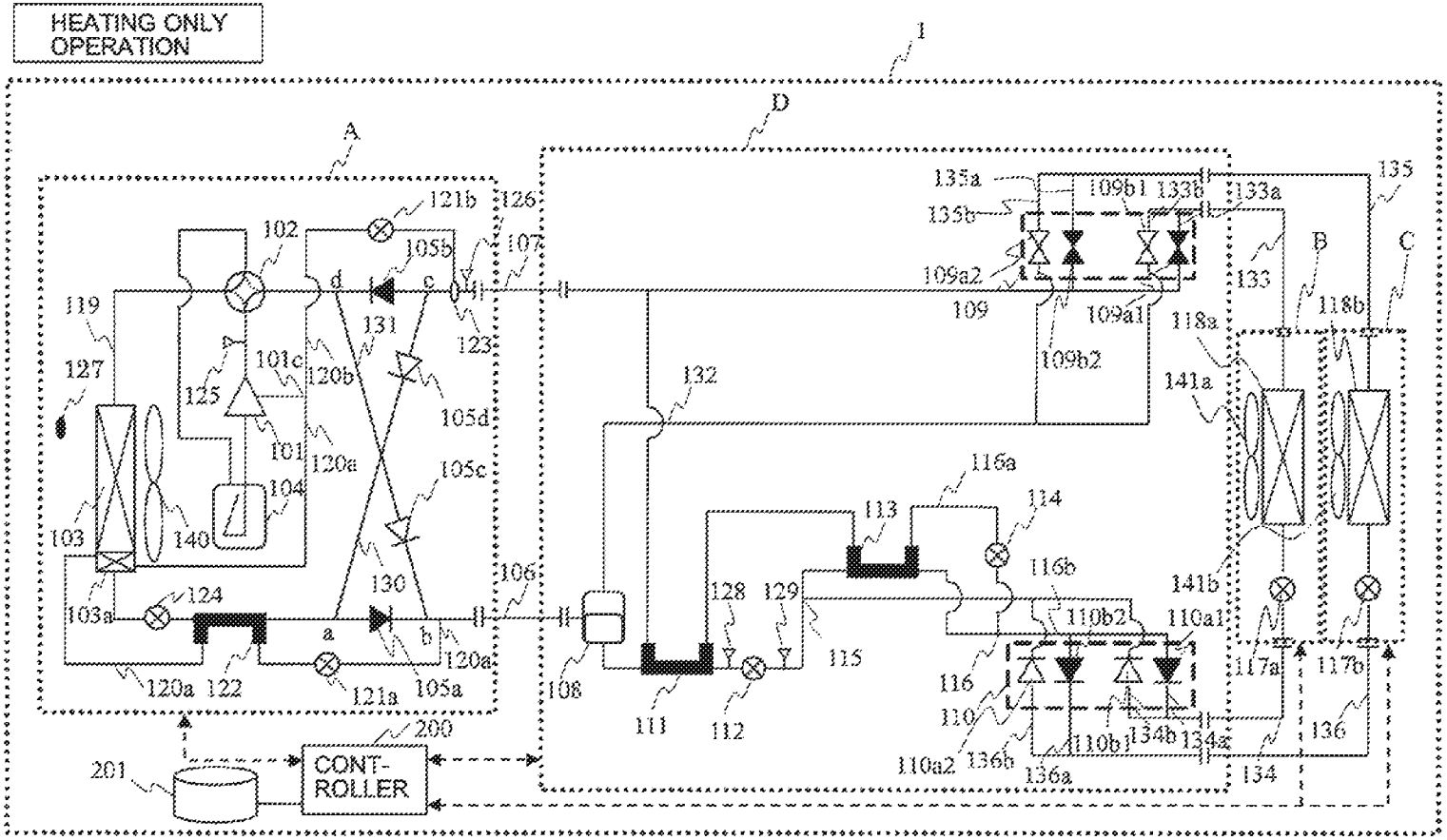
FIG. 3 is a refrigerant circuit diagram of the air-conditioning apparatus according to Embodiment 1 in a heating only operation.

FIG. 3 is a refrigerant circuit diagram of the air-conditioning apparatus according to Embodiment 1 in the heating only operation.

The operations of the devices and the flow of the refrigerant in the heating only operation will now be described with reference to FIG. 3.

The following description assumes that all indoor units are performing cooling without interruption.

The compressing device 101 compresses the refrigerant drawn by suction and discharges a high-pressure gas refrigerant.

The high-pressure gas refrigerant discharged from the compressing device 101 flows through the four-way switching valve 102 into the check valve 105*c*.

In this process, the high-pressure gas refrigerant does not flow toward the check valve 105*b* or 105*a* because of factors associated with the relationship of pressure of the refrigerant.

The high-pressure gas refrigerant then flows through the second main pipe 106 into the relay device D.

The controller 200 switches the switching valve 109*a*1 that is provided in the connection pipe 133*a* to a closed state.

The controller 200 switches the switching valve 109*b*2 that is provided in the connection pipe 135*a* to a closed state.

The controller 200 switches the switching valve 109*b*1 that is provided in the connection pipe 133*b* to an open state.

The controller 200 switches the switching valve 109*a*2 that is provided in the connection pipe 135*b* to an open state.

Hence, the gas refrigerant separated by the gas-liquid separating device 108 flows from the first branch portion 109, flows through the connection pipes 133 and 135, and flows toward the indoor units B and C, respectively.

While passing through the indoor heat exchangers 118*a* and 118*b*, the high-pressure gas refrigerant is condensed by exchanging heat with the indoor air in a corresponding air-conditioned space.

In this process, the refrigerant exchanges heat with the indoor air and heats it, whereby the indoor space is heated.

The refrigerant having passed through the indoor heat exchangers 118*a* and 118*b* turns into a liquid refrigerant, and further passes through the expansion means 117*a* and 117*b*.

The controller 200 controls the opening degrees of the expansion means 117*a* and 117*b*.

In the indoor unit B, the expansion means 117*a* controls the pressure of the liquid refrigerant having flowed out of a corresponding indoor heat exchanger 118*a*.

The opening degree of the expansion means 117*a* is controlled on the basis of the degree of supercooling of the refrigerant at the outlet of the indoor heat exchanger 118*a*.

A low-pressure liquid refrigerant or a two-phase gas-liquid refrigerant generated by controlling the opening degree of the expansion means 117*a* flows through the connection pipe 134 into the second branch portion 110.

The refrigerant having flowed into the second branch portion 110 flows into the first merging portion 115 through the check valve 110*b*1 that is connected to the connection pipes 134*b*.

In the indoor unit C, the expansion means 117*b* controls the pressure of the liquid refrigerant having flowed out of a corresponding indoor heat exchanger 118*b*.

The opening degree of the expansion means 117*b* is controlled on the basis of the degree of supercooling of the refrigerant at the outlet of the indoor heat exchanger 118*b*.

A low-pressure liquid refrigerant or a two-phase gas-liquid refrigerant generated by controlling the opening degree of the expansion means 117*b* flows through the connection pipe 136 into the second branch portion 110.

The refrigerant having flowed into the second branch portion 110 flows into the first merging portion 115 through the check valve 110*a*2 that is connected to the connection pipe 136*b*.

The refrigerant having flowed from the first merging portion 115 into the second heat exchanger 113 flows from the second merging portion 116 into the second flow control device 114.

Then, the refrigerant having flowed out of the second flow control device 114 passes through the first bypass pipe 116*a*, the second heat exchanger 113, and the first heat exchanger 111, and flows into the first main pipe 107.

In this process, the opening degree of the second flow control device 114 is controlled, whereby the low-pressure two-phase gas-liquid refrigerant flows into the first main pipe 107.

The refrigerant having flowed through the first main pipe 107 into the heat source device A flows through the check valve 105*d* into the heat-source-side heat exchanger 103.

While the refrigerant having flowed into the heat-source-side heat exchanger 103 passes through the heat-source-side heat exchanger 103, the refrigerant exchanges heat with the outdoor air and evaporates, thereby turning into a gas refrigerant.

The gas refrigerant flows through the four-way switching valve 102 and the accumulator 104, and returns to the compressing device 101.

The above-mentioned arrangement corresponds to a circulation passage of the refrigerant in the heating only operation.

The controller 200 controls the discharge capacity of the compressing device 101 and the volume of airflow produced by the air-sending devices 140, 141*a*, and 141*b*, and provides a capacity corresponding to the load imposed on the indoor units B and C.

With this operation, the controller 200 controls the condensing temperatures of the refrigerant in the indoor heat exchangers 118*a* and 118*b* and the evaporating temperature of the refrigerant in the heat-source-side heat exchanger 103 to reach predetermined target temperatures.

In the heating only operation, the controller 200 controls the opening degrees of the injection flow control devices 121*a* and 121*b* on the basis of the temperature of the outdoor air.

That is, the controller 200 controls the opening degree of the injection flow control device 121*a* on the basis of the temperature of the outdoor air, supplies the high-pressure gas refrigerant into the injection pipe 120*a*, and supplies the high-pressure gas refrigerant from the injection port 101*c* into the suction end of the high-stage-side compressor 101*b*.

Furthermore, the controller 200 controls the opening degree of the injection flow control device 121*b*, supplies the liquid refrigerant into the injection pipe 120*b*, and further supplies the liquid refrigerant from the injection port 101*c* into the suction side of the high-stage-side compressor 101*b*.

Details of the injection operation will be described later.

The capacity provided by the compressing device 101 is maintained by, for example, increasing the driving frequency.

While the above description assumes that in the cooling only operation and the heating only operation, both the indoor units B and C are in operation, one of the indoor units B and C may be kept stopped, for example.

If, for example, one of the indoor units is kept stopped, and the overall load of the air-conditioning apparatus 1 is small, the capacity to be provided by the compressing device 101 may be changed while the low-stage-side compressor 101*a* or the high-stage-side compressor 101*b* is kept stopped.

[Heating Main Operation]

Figure 4:
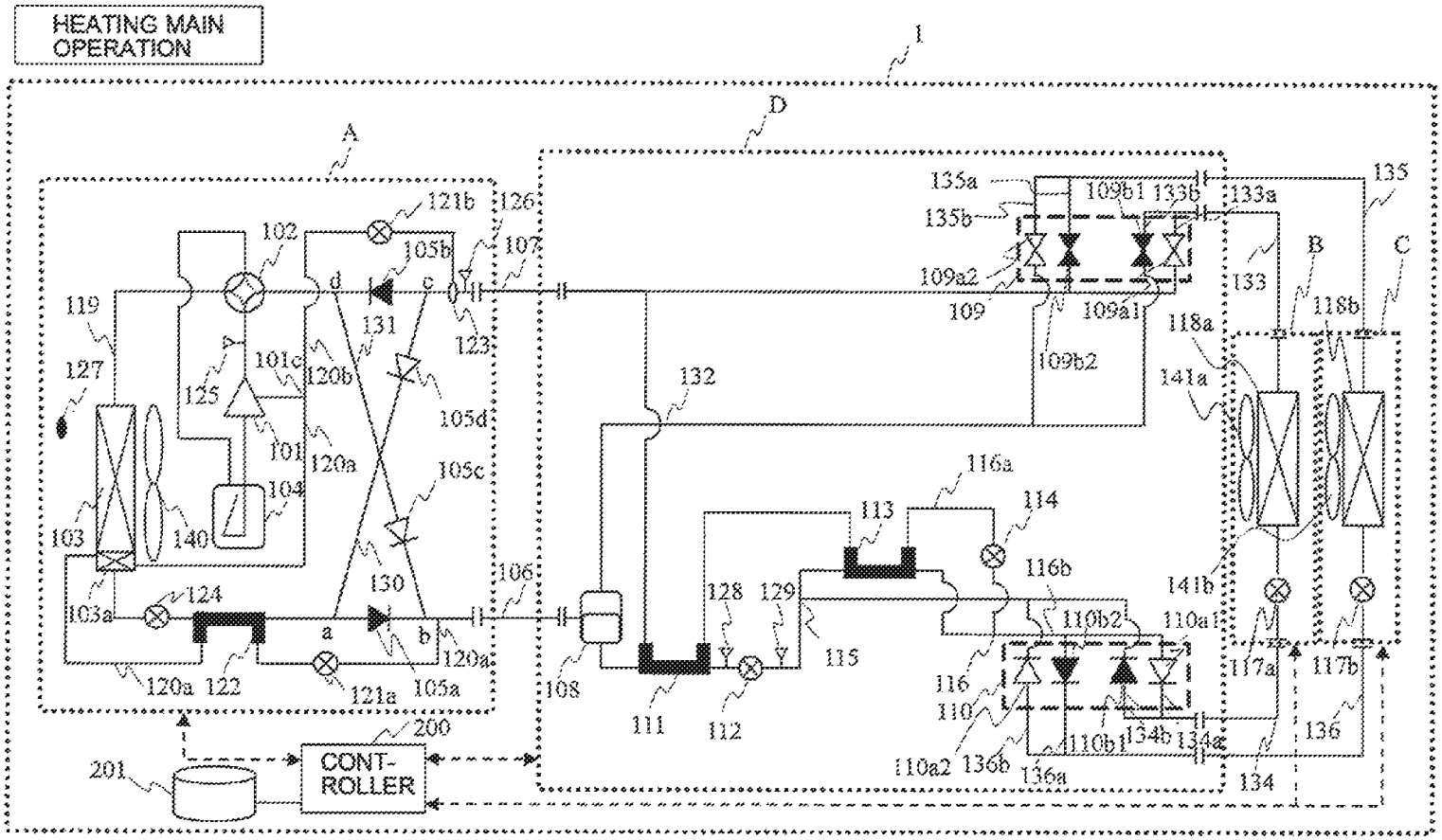
FIG. 4 is a refrigerant circuit diagram of the air-conditioning apparatus according to Embodiment 1 in a heating main operation.

FIG. 4 is a refrigerant circuit diagram of the air-conditioning apparatus according to Embodiment 1 in the heating main operation.

The operations of the devices and the flow of the refrigerant in the heating main operation will now be described with reference to FIG. 4.

The following description assumes that the indoor unit C performs heating while the indoor unit B performs cooling.

The operations of the devices and the flow of the refrigerant in the heat source device A are the same as in the heating only operation that has been described with reference to FIG. 3.

The controller 200 switches the switching valve 109*a*1 connected to the connection pipe 133*a* to an open state.

The controller 200 switches the switching valve 109*a*2 connected to the connection pipe 135*b* to an open state.

The controller 200 switches the switching valve 109*b*1 connected to the connection pipe 133*b* to a closed state.

The controller 200 switches the switching valve 109*b*2 connected to the connection pipe 135*a* to a closed state.

Therefore, the gas refrigerant separated by the gas-liquid separating device 108 flows only toward the indoor unit C from the first branch portion 109 via the connection pipe 135.

The flow of the refrigerant in the indoor unit C that is performing heating is the same as in the heating only operation that has been described with reference to FIG. 3.

On the other hand, the flow of the refrigerant in the indoor unit B that is performing cooling is different from that in the indoor unit C that is performing heating.

In the indoor unit C, a low-pressure liquid refrigerant or a two-phase gas-liquid refrigerant generated by controlling the opening degree of the expansion means 117*b* flows through the connection pipe 136 into the second branch portion 110.

The refrigerant having flowed into the second branch portion 110 flows through the check valve 110*a*2 connected to the connection pipe 136*b* into the first merging portion 115.

The controller 200 closes the first flow control device 112, thereby blocking the flow of the refrigerant between the gas-liquid separating device 108 and the first merging portion 115.

Therefore, the refrigerant flows from the first merging portion 115 into the second merging portion 116 through the second heat exchanger 113.

A part of the refrigerant having flowed into the second merging portion 116 flows into the second bypass pipe 116*b*, and flows through the check valve 110*a*1 connected to the connection pipe 134*a* and through the connection pipe 134 into the indoor unit B.

The controller 200 controls the opening degree of the expansion means 117*a*.

In the indoor unit B, the expansion means 117*a* controls the pressure of the liquid refrigerant having flowed into it from the connection pipe 134.

The opening degree of the expansion means 117*a* is controlled on the basis of the degree of superheat of the refrigerant at the outlet of a corresponding indoor heat exchanger 118*a*.

A low-pressure liquid refrigerant or a two-phase gas-liquid refrigerant generated by controlling the opening degree of the expansion means 117*a* flows into the indoor heat exchanger 118*a* of the indoor unit B.

While passing through the indoor heat exchanger 118*a*, the low-pressure liquid refrigerant or the two-phase gas-liquid refrigerant exchanges heat with the indoor air in the air-conditioned space and thus evaporates.

In this process, the refrigerant exchanges heat with the indoor air and cools it, whereby the indoor space is cooled.

The refrigerant having passed through the indoor heat exchanger 118*a* turns into a low-pressure gas refrigerant, and flows into a corresponding connection pipe 133.

The low-pressure gas refrigerant or the two-phase gas-liquid refrigerant (low-pressure refrigerant) having flowed through the connection pipe 133 passes through the switching valve 109*a*1 connected to the connection pipe 133*a*, and flows into the first main pipe 107.

On the other hand, a part of the refrigerant having flowed through the second heat exchanger 113 into the second merging portion 116 flows into the second flow control device 114.

The refrigerant having flowed out of the second flow control device 114 passes through the first bypass pipe 116*a*, the second heat exchanger 113, and the first heat exchanger 111, and flows into the first main pipe 107.

In this process, the controller 200 controls the opening degree of the second flow control device 114, whereby an amount of refrigerant necessary for the indoor unit C is supplied, and the remaining amount of refrigerant flows into the first main pipe 107 via the first bypass pipe 116*a*.

As in the heating only operation described above, in the heating main operation, the controller 200 controls the opening degrees of the injection flow control devices 121*a* and 121*b* on the basis of the temperature of the outdoor air. Details of the injection operation will be described later.

In the heating main operation, the refrigerant having flowed out of the indoor unit that is performing heating (in this case, the indoor unit C) flows into the indoor unit that is performing cooling (in this case, the indoor unit B).

Therefore, when the indoor unit B that is performing cooling stops its operation, the amount of two-phase gas-liquid refrigerant which flows through the first bypass pipe 116*a* increases.

On the other hand, as the load imposed on the indoor unit B that is performing cooling increases, the amount of two-phase gas-liquid refrigerant flowing through the first bypass pipe 116*a* decreases.

Therefore, while the amount of refrigerant necessary in the indoor unit C that is performing heating remains the same, the load imposed on the indoor heat exchanger 118*a* (evaporator) of the indoor unit B that is performing cooling changes.

In the heating main operation as well, the controller 200 controls the discharge capacity of the compressing device 101 and the volume of airflow produced by the air-sending devices 140, 141*a*, and 141*b*, and provides a capacity corresponding to the load imposed on the indoor units B and C.

[Cooling Main Operation]

Figure 5:
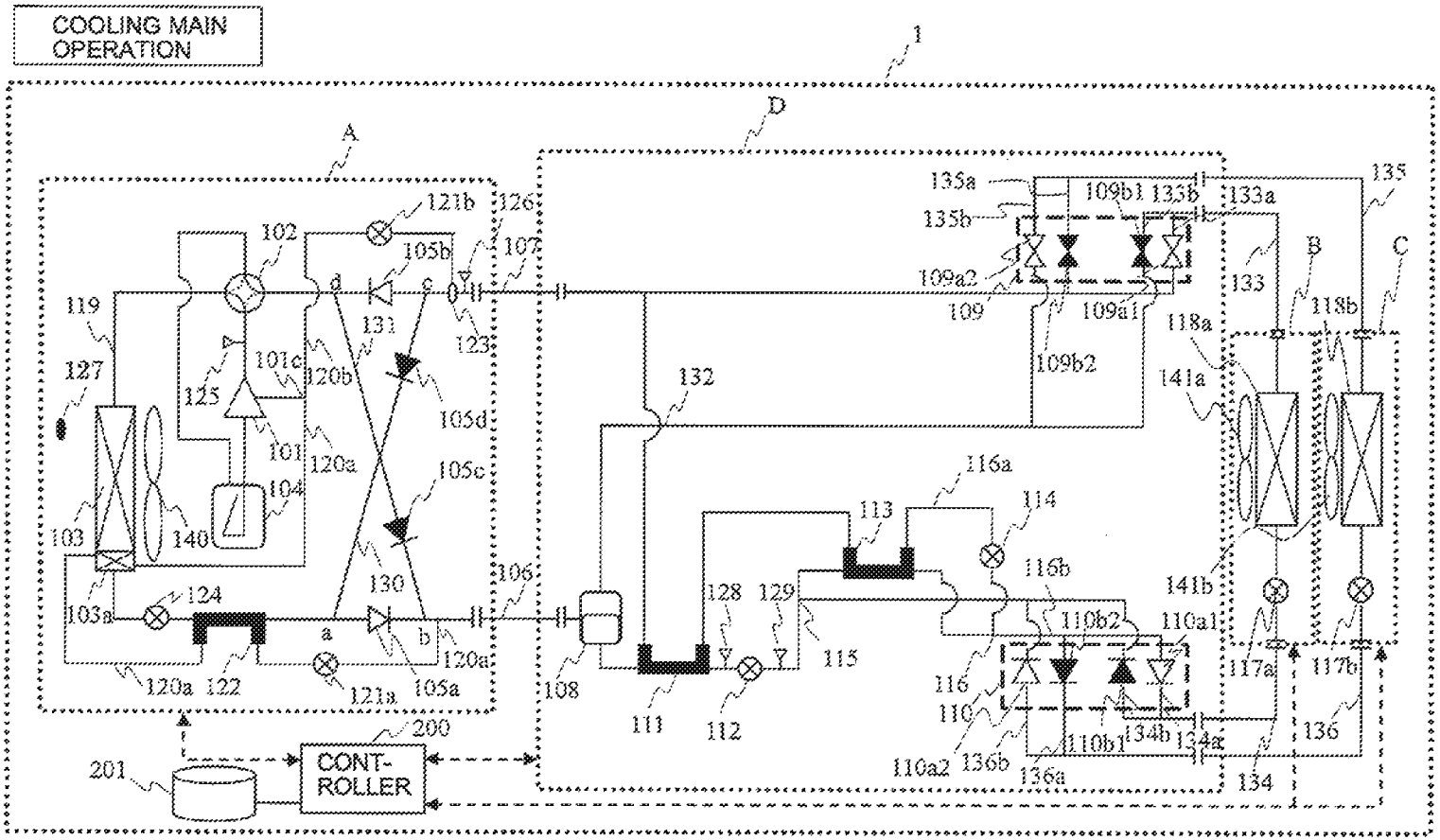
FIG. 5 is a refrigerant circuit diagram of the air-conditioning apparatus according to Embodiment 1 in a cooling main operation.

FIG. 5 is a refrigerant circuit diagram of the air-conditioning apparatus according to Embodiment 1 in the cooling main operation.

The operations of the devices and the flow of the refrigerant in the cooling main operation will now be described with reference to FIG. 5.

The following description assumes that the indoor unit C performs heating while the indoor unit B performs cooling.

The operations of the devices and the flow of the refrigerant in the heat source device A are the same as in the cooling only operation that has been described with reference to FIG. 1.

However, in the cooling main operation, the condensing capacity of the refrigerant in the heat-source-side heat exchanger 103 is controlled such that the refrigerant flowing through the second main pipe 106 into the relay device D becomes a two-phase gas-liquid refrigerant.

That is, the controller 200 controls the discharge capacity of the compressing device 101 and the volume of airflow produced by the air-sending device 140, thereby controlling the condensing capacity of the refrigerant in the heat-source-side heat exchanger 103.

The gas-liquid separating device 108 separates the refrigerant having flowed into the relay device D into gas and liquid refrigerants.

The refrigerant flowing into the relay device D in the cooling main operation is a two-phase gas-liquid refrigerant.

The controller 200 switches the switching valve 109*a*1 connected to the connection pipe 133*a* to an open state.

The controller 200 switches the switching valve 109*a*2 connected to the connection pipe 135*b* to an open state.

The controller 200 switches the switching valve 109*b*1 connected to the connection pipe 133*b* to a closed state.

The controller 200 switches the switching valve 109*b*2 connected to the connection pipe 135*a* to a closed state.

Therefore, the gas refrigerant separated by the gas-liquid separating device 108 flows only toward the indoor unit C from the first branch portion 109 via the connection pipe 135.

In the indoor unit C, while passing through the indoor heat exchanger 118*b*, the high-pressure gas refrigerant is condensed by heat exchange and turns into a liquid refrigerant. The liquid refrigerant passes through the expansion means 117*b*.

In this process, the refrigerant exchanges heat with the indoor air and heats it, whereby the indoor space is heated.

The refrigerant having passed through the expansion means 117*b* turns into a liquid refrigerant whose pressure has been slightly reduced. The liquid refrigerant flows through the connection pipe 136 into the second branch portion 110.

The refrigerant having flowed into the second branch portion 110 flows through the check valve 110*a*2 connected to the connection pipe 136*b* into the first merging portion 115.

The controller 200 controls the opening degree of the first flow control device 112, and supplies the liquid refrigerant separated by the gas-liquid separating device 108 into the first merging portion 115.

Therefore, the liquid refrigerant having flowed from the gas-liquid separating device 108 and the liquid refrigerant having flowed from the second branch portion 110 merge in the first merging portion 115.

The merged liquid refrigerant flows from the first merging portion 115 into the second merging portion 116 through the second heat exchanger 113.

A part of the refrigerant having flowed into the second merging portion 116 flows into the second bypass pipe 116*b*, and further flows into the indoor unit B through the check valve 110*a*1 connected to the connection pipe 134*a* and through the connection pipe 134.

The controller 200 controls the opening degree of the expansion means 117*a*. In the indoor unit B, the expansion means 117*a* controls the pressure of the liquid refrigerant having flowed into it from the connection pipe 134.

The opening degree of the expansion means 117*a* is controlled on the basis of the degree of superheat of the refrigerant at the outlet of the indoor heat exchanger 118*a*.

A low-pressure liquid refrigerant or a two-phase gas-liquid refrigerant generated by controlling the opening degree of the expansion means 117*a* flows into the indoor heat exchanger 118*a* of the indoor unit B.

While passing through the indoor heat exchanger 118*a*, the low-pressure liquid refrigerant or the two-phase gas-liquid refrigerant exchanges heat with the indoor air in the air-conditioned space and thus evaporates.

In this process, the refrigerant exchanges heat with the indoor air and cools it, whereby the indoor space is cooled.

The refrigerant having passed through the indoor heat exchanger 118*a* turns into a low-pressure gas refrigerant, and flows into a corresponding connection pipe 133.

The low-pressure gas refrigerant or the two-phase gas-liquid refrigerant (low-pressure refrigerant) having flowed through the connection pipe 133 flows through the switching valve 109*a*1 connected to the connection pipe 133*a* into the first main pipe 107.

As described above, in the cooling main operation, the heat-source-side heat exchanger 103 functions as a condenser.

The refrigerant having passed through the indoor unit C that is performing heating is used as a refrigerant for the indoor unit B that is performing cooling.

In this process, if, for example, the load imposed on the indoor unit B is small and the amount of refrigerant flowing through the indoor unit B is kept small, the controller 200 increases the opening degree of the second flow control device 114.

With this operation, the refrigerant can be supplied through the first bypass pipe 116*a* into the first main pipe 107 without supplying an excess amount of refrigerant to the indoor unit B that is performing cooling.

In the cooling main operation as well, the controller 200 controls the discharge capacity of the compressing device 101 and the volume of airflow produced by the air-sending devices 140, 141*a*, and 141*b*, and provides a capacity corresponding to the load imposed on the indoor units B and C.

In the cooling main operation, the controller 200 sets the opening degrees of the injection flow control devices 121*a* and 121*b* to zero.

The injection flow control device 121*a* is set to zero opening degree, and does not supply the refrigerant into the injection pipe 120*a*.

The injection flow control device 121*b* is set to zero opening degree, and does not supply the refrigerant into the injection pipe 120*b*.

[Control Operation for Injection]

When the temperature of the outdoor air lowers, the pressure of the refrigerant in the heat-source-side heat exchanger 103 that functions as an evaporator in the heating only operation and the heating main operation also lowers. That is, the pressure of the refrigerant on the suction side of the compressing device 101 lowers.

Therefore, the amount of refrigerant drawn into the compressing device 101 by suction (the refrigerant in circulation) reduces (the density of refrigerant reduces).

As the amount of refrigerant drawn into the compressing device 101 by suction reduces, the compression ratio increases, whereby the temperature of the refrigerant discharged from the compressing device 101 (discharge temperature), in turn, increases.

Hence, the controller 200 changes the opening degree of at least one of the injection flow control devices 121*a* and 121*b*.

Thus, some refrigerant is supplied from the injection port 101*c*, whereby the density of refrigerant is increased.

Furthermore, the temperature of the refrigerant drawn into the high-stage-side compressor 101*b* by suction is reduced so that the temperature of the refrigerant discharged from the compressing device 101 does not rise excessively.

According to Embodiment 1, in the heating only operation and the heating main operation, the high-pressure gas refrigerant, as discharged from the compressing device 101, is divided at one end of the injection pipe 120*a*.

The other end of the injection pipe 120*a* is connected to the injection port 101*c* of the compressing device 101.

The controller 200 reduces the pressure of the refrigerant passing through the injection pipe 120*a* by using the injection flow control device 121*a*.

A part of the injection pipe 120*a* extends through the injection internal heat exchanger 122.

In the injection internal heat exchanger 122, a refrigerant stream which flows through the injection pipe 120*a* and a refrigerant stream which flows into the heat-source-side heat exchanger 103 exchange heat with each other, whereby the refrigerant is condensed.

The refrigerant, as condensed in the injection internal heat exchanger 122, flows from the injection port 101*c* of the compressing device 101 into the high-stage-side compressor 101*b*.

Thus, the pressure of the high-pressure refrigerant, as discharged from the compressing device 101 and stabilized, is reduced by the injection flow control device 121*a*, whereby a satisfactory differential pressure is produced. Consequently, a predetermined amount of refrigerant stably flows from the injection port 101*c* into the compressing device 101.

According to Embodiment 1, in the heating only operation and the heating main operation, the low-pressure, two-phase gas-liquid refrigerant having passed through the indoor units B and C and the relay device D is separated into liquid and gas refrigerants. The gas refrigerant is divided at one end of the injection pipe 120*b*. The other end of the injection pipe 120*b* is connected to the injection port 101*c* of the compressing device 101.

The controller 200 reduces the pressure of the refrigerant which passes through the injection pipe 120*b* by using the injection flow control device 121*b*.

With this operation, the refrigerant having passed through those indoor units that are performing heating is injected. Therefore, a large amount of refrigerant is allowed to flow through the indoor units that are performing heating.

Hence, when only a small amount of refrigerant needs to be injected, for example, when a sufficient differential pressure can be produced in the heating only operation; when the temperature of the outdoor air is relatively high; or when the heating load is small, a certain heating capacity can be provided and the operation efficiency can be increased mainly by utilizing injection from the injection pipe 120*b*.

With the injection internal heat exchanger 122, the high-pressure refrigerant passing through the injection pipe 120*a* exchanges heat with the low-pressure, two-phase gas-liquid refrigerant having passed through those indoor units that are performing cooling and the relay device D.

Thus, the enthalpy of the refrigerant to be injected can be reduced.

The enthalpy of the low-pressure, two-phase gas-liquid refrigerant having passed through the indoor units that are performing cooling and the relay device D is increased. Therefore, the load on the heat-source-side heat exchanger 103 can be reduced. Consequently, the low-side pressure can be raised, and the heating capacity can be increased.

Figure 6:
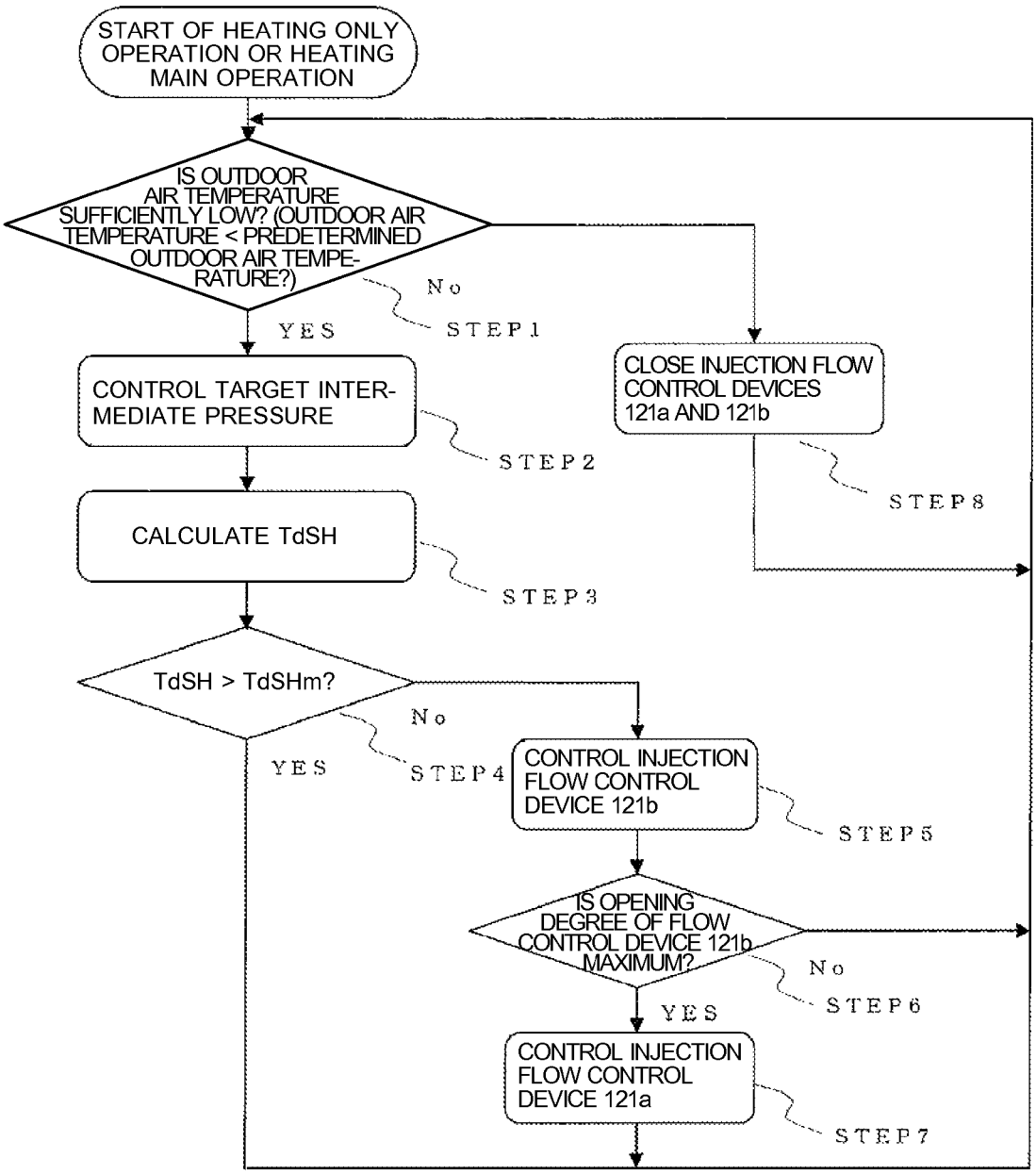
FIG. 6 is a flowchart illustrating an exemplary operation of the air-conditioning apparatus according to Embodiment 1.

FIG. 6 is a flowchart illustrating an exemplary operation of the air-conditioning apparatus according to Embodiment 1.

Details of the control operation associated with injection will now be described with reference to FIG. 6.

(STEP 1)

The controller 200 determines whether the outdoor air temperature is lower than a predetermined outdoor air temperature on the basis of a signal transmitted from the outdoor air temperature detector 127 (determination as to whether the outdoor air temperature is sufficiently low).

If the outdoor air temperature is not lower than the predetermined outdoor air temperature, the process proceeds to STEP 8.

(STEP 2)

In contrast, if the outdoor air temperature is lower than the predetermined outdoor air temperature, the controller 200 controls the opening degree of the flow control device 124 such that the pressure detected by the pressure detector 126 reaches a predetermined target intermediate pressure.

(STEP 3) On the basis of the value detected by the pressure detector 125, the controller 200 detects the pressure Pd and the temperature Td of the refrigerant as discharged from the compressing device 101.

On the basis of the pressure Pd, the controller 200 calculates the condensing temperature Tc.

The controller 200 calculates a discharge degree of superheat TdSH, which is the difference between the temperature Td and the condensing temperature Tc.

(STEP 4)

The controller 200 determines whether the discharge degree of superheat TdSH calculated in STEP 3 is higher than a predetermined target discharge degree of superheat TdSHm.

If the discharge degree of superheat TdSH is higher than the target discharge degree of superheat TdSHm, the process returns to STEP 1.

(STEP 5)

In contrast, if the discharge degree of superheat TdSH is not higher than the target discharge degree of superheat TdSHm, the controller 200 controls the opening degree of the injection flow control device 121*b* such that the discharge degree of superheat TdSH reaches the target discharge degree of superheat TdSHm.

(STEP 6)

The controller 200 determines whether the opening degree of the injection flow control device 121*b* takes a maximum value.

If the opening degree of the injection flow control device 121*b* does not take a maximum value, the process returns to STEP 1.

(STEP 7)

If the opening degree of the injection flow control device 121*b* takes a maximum value, the controller 200 controls the opening degree of the injection flow control device 121*a* such that the discharge degree of superheat TdSH reaches the target discharge degree of superheat TdSHm.

(STEP 8)

If it is determined in STEP 1 that the outdoor air temperature is not lower than the predetermined outdoor air temperature, the controller 200 closes the injection flow control devices 121*a* and 121*b*. Then, the process returns to STEP 1. If the injection flow control devices 121*a* and 121*b* are closed, they remain the same.

Thus, the refrigerant is prevented from flowing into the injection pipes 120*a* and 120*b*, and control is performed by normal operation.

As described above, according to Embodiment 1, in the heating only operation in which a certain differential pressure can be produced and a stable flow rate of injection can be provided, and in the heating main operation in which the outdoor air temperature is relatively high and the flow rate of injection need not be high, the refrigerant having passed through the indoor units is injected. If a sufficient flow rate of injection is required, control is performed so that the high-pressure gas refrigerant having been discharged from the compressing device 101 and the two-phase refrigerant having passed through the indoor units are made to exchange heat with each other for condensation, and the condensed refrigerant is injected into the compressing device 101.

Hence, if the pressure of the refrigerant discharged from one of the indoor heat exchangers 118*a* and 118*b* functioning as an evaporator is controlled while a certain heating capacity provided to those indoor units that are performing heating is ensured (maintained), a certain cooling capacity provided to those indoor units that are performing cooling can be ensured (maintained).

Thus, an efficient operation can be implemented utilizing injection, and the aforementioned pipe connection configuration employed in such a system.

Embodiment 2

Embodiment 2 assumes an evaporating operation performed in the heating main operation in the heat source device A to prevent the freezing of those indoor units that are performing cooling.

The flow of the refrigerant in the heating main operation according to Embodiment 2 is the same as in the heating main operation that has been described above in Embodiment 1 with reference to FIG. 4.

The controller 200 according to Embodiment 2 performs not only the operations described in Embodiment 1 but also an evaporating operation for preventing the freezing of those indoor units that are performing cooling.

In the heating main operation, the controller 200 controls the opening degree of the flow control device 124 such that the intermediate pressure detected by the pressure detector 126 reaches a predetermined pressure (a pressure that makes the saturation temperature 0 degrees C. or higher).

In such a control operation, the evaporating temperature of the indoor heat exchanger 118*a* of the indoor unit B that is performing cooling can be maintained at 0 degrees C. or higher, and the freezing of the indoor unit B that is performing cooling can be prevented.

Embodiment 3

While Embodiments 1 and 2 have been described assuming that the air-conditioning apparatus 1 includes the relay device D and is capable of a simultaneous cooling and heating operation, the present invention is not limited to such a configuration.

Figure 7:
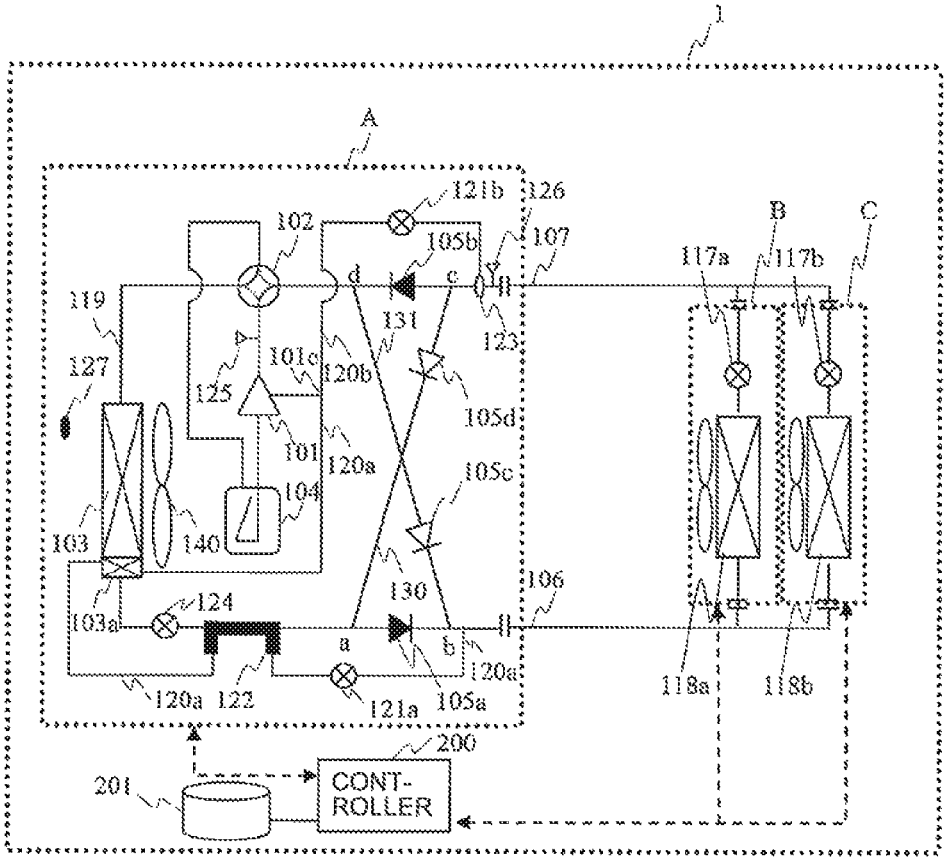
FIG. 7 is a diagram illustrating an exemplary configuration of a refrigerant circuit of an air-conditioning apparatus according to Embodiment 3.

For example, as illustrated in FIG. 7, the heat source device A may be connected to the indoor units B and C without the relay device D.

The present invention is applicable, for example, to an air-conditioning apparatus 1 that switches the operation between cooling and heating without the relay device D.

The present invention is also applicable, for example, to an air-conditioning apparatus 1 including indoor units (load-side units) provided exclusively for heating.

The invention claimed is:

1. An air-conditioning apparatus comprising:

a heat source device including a compressing device that compresses a refrigerant, and a heat-source-side heat exchanger that exchanges heat between the refrigerant and outdoor air;

an indoor unit including an indoor heat exchanger that exchanges heat between conditioned air and the refrigerant, and expansion means;

a refrigerant pipe that connects the heat source device and the indoor unit to each other and forms a refrigerant circuit;

a first injection pipe allowing a part of the refrigerant, as discharged from the compressing device, to flow into an intermediate portion of a compression stroke of the compressing device;

a first injection flow control device that controls an amount of refrigerant passing through the first injection pipe;

an injection internal heat exchanger that exchanges heat between a refrigerant stream that flows through the first injection pipe and a refrigerant stream that flows into the heat-source-side heat exchanger aft passing through the indoor unit;

a second injection pipe having one end connected to the refrigerant pipe and allowing a part of the refrigerant that has flowed through the indoor unit into the heat source device and is to flow into the heat-source-side heat exchanger to flow into the intermediate portion of the compression stroke of the compressing device;

a second injection flow control device that controls an amount of refrigerant passing through the second injection pipe;

an injection port that has a joint portion connecting the first and second injection pipes and that injects the refrigerant from the first and second injection pipes into the intermediate portion of the compression stroke of the compressing device, and a controller that controls opening degrees of the first injection flow control device and the second injection flow control device effecting the degree of superheat of the refrigerant, as discharged from the compressing device, to reach a predetermined value, wherein when a temperature of the outdoor air is not more than a predetermined temperature, the controller controls the opening degree of the second injection flow control device, and when the opening degree of the second injection flow control device is not less than a predetermined opening degree, the controller maximizes the opening degree of the first injection flow control device.

2. The air-conditioning apparatus of claim 1, comprising:

a plurality of indoor units including the indoor unit, and a relay device provided between the heat source device and each of the plurality of indoor units, wherein the relay device forms a passage in which a gas refrigerant is supplied to any of the plurality of indoor units that perform heating while a liquid refrigerant is supplied to any of the plurality of indoor units that perform cooling.

3. The air-conditioning apparatus of claim 1, wherein the compressing device includes a plurality of compressors that are connected in series to each other; and the joint portion is located between the plurality of compressors.

4. The air-conditioning apparatus of claim 1, wherein the heat-source-side heat exchanger includes an injection heat exchanging portions and when the heat-source-side heat exchanger functions as an evaporator, the injection heat exchanging portion is configured to exchange heat between a refrigerant stream that flows through the heat-source-side heat exchanger and the refrigerant stream that flows through the first injection pipe.

* * * * *